US012747606B2

(12) United States Patent
Cord et al.

(10) Patent No.: US 12,747,606 B2
(45) Date of Patent: Sep. 29, 2026

(54) AUTOMATED PARKING SYSTEM FOR MOTOR CARS

(71) Applicant: Stanley Robotics, Versailles (FR)

(72) Inventors: Aurélien Cord, Paris (FR); Mathieu Lips, Paris (FR)

(73) Assignee: Stanley Robotics, Versailles (FR)

( * ) Notice: Subject to any disclaimer, the term of this patent is extended or adjusted under 35 U.S.C. 154(b) by 230 days.

(21) Appl. No.: 18/687,083

(22) PCT Filed: Aug. 19, 2022

(86) PCT No.: PCT/FR2022/051587
§ 371 (c)(1),
(2) Date: Feb. 27, 2024

(87) PCT Pub. No.: WO2023/026007
PCT Pub. Date: Mar. 2, 2023

(65) Prior Publication Data

US 2025/0003246 A1 Jan. 2, 2025

(30) Foreign Application Priority Data

Aug. 27, 2021 (FR) ..... 2109001

(51) Int. Cl.
*E04H 6/24* (2006.01)
*E04H 6/36* (2006.01)
*E04H 6/42* (2006.01)

(52) U.S. Cl.
CPC ..... *E04H 6/24* (2013.01); *E04H 6/36* (2013.01); *E04H 6/424* (2013.01)

(58) Field of Classification Search
CPC ..... G06Q 10/08
See application file for complete search history.

(56) References Cited

U.S. PATENT DOCUMENTS 6,048,155 A * 4/2000 Irish ..... E04H 6/187 206/335
2010/0234980 A1* 9/2010 Lapre ..... B66F 9/06 414/807

(Continued)

FOREIGN PATENT DOCUMENTS

CN 204457019 7/2015
CN 108331406 A 7/2018

(Continued)

OTHER PUBLICATIONS

Benfriha, Laid, and Yakoub Bouaicha. Study and design of an automated parking: the structure. Diss. 2018. (Year: 2018).*

(Continued)

*Primary Examiner* — Emmett K. Walsh
(74) *Attorney, Agent, or Firm* — TraskBritt

(57) ABSTRACT

An automated parking system for motor cars includes at least one first infrastructure comprising a storage space for storing vehicles and having transfer stations between the public access road and the storage space, at least one autonomous robot of a first type having means for lifting an autonomous car from the outside and moving it in the first storage space, as well as a supervisor for calculating the trajectories of the at least one autonomous robot. The system further includes at least one second infrastructure comprising a second storage space for storing vehicles and at least one autonomous transporter of a second type comprising means for driving on the public road and having a platform for receiving a motor vehicle.

4 Claims, 2 Drawing Sheets

(56) References Cited

U.S. PATENT DOCUMENTS

| | | | | |
|---|---|---|---|---|
| 2017/0167154 | A1 | 6/2017 | Jarvinen et al. | |
| 2018/0086559 | A1* | 3/2018 | Lindbo | A62C 35/68 |

FOREIGN PATENT DOCUMENTS

| | | | |
|---|---|---|---|
| EP | 2173581 | B1 | 4/2011 |
| JP | 2001-188909 | A | 7/2001 |
| JP | 2016-042070 | A | 8/2016 |
| JP | 2019-035261 | A | 3/2019 |
| JP | 2020-090281 | A | 6/2020 |
| JP | 2021-051502 | A | 4/2021 |
| WO | 2020/128380 | A1 | 6/2020 |
| WO | 2021/009453 | A1 | 1/2021 |

OTHER PUBLICATIONS

International Search Report for Application No. PCT/FR2022/051587 dated Dec. 7, 2022, 2 pages.
International Written Opinion for Application No. PCT/FR2022/051587 dated Dec. 7, 2022, 5 pages.
European Communication under Article 94/(3) CBE for Application No. 22769323.1 dated Jan. 15, 2026, 9 pages with English translation.
Japanese Notice of Reasons for Refusal for Application No. 2023-556525 dated Oct. 28, 2024, 3 pages.

* cited by examiner

AUTOMATED PARKING SYSTEM FOR MOTOR CARS

CROSS-REFERENCE TO RELATED APPLICATIONS

This application is a national phase entry under 35 U.S.C. § 371 of International Patent Application PCT/FR2022/051587, filed Aug. 19, 2022, designating the United States of America and published as International Patent Publication WO 2023/026007 A1 on Mar. 2, 2023, which claims the benefit under Article 8 of the Patent Cooperation Treaty of French Patent Application Serial No. 2109001, filed Aug. 27, 2021.

TECHNICAL FIELD

The present disclosure relates to the field of smart parking of motor cars, in particular, for serving high traffic public infrastructures such as airports. Parking lots are essential infrastructures and are subject to pressures to maximize capacity, improve financial performance and mitigate their impact on the environment and community.

BACKGROUND

For such infrastructures, parking is generally the first and last impression that users retain. Even if they do not recognize it, parking has a major effect on how people evaluate the relevant infrastructure. For airports, user parking infrastructures as well as personnel must be welcoming and functional, the flow of the passengers must be fluid and the overall experience must be convenient and well organized.

Digital innovations can add a customized layer by facilitating the connection between all the services offered by the airport and the customers' needs.

Historically, the involvement of valets made it possible to respond occasionally to the parking optimization, but such a solution can be envisaged only for a small number of users. Also proposed in application WO2021009453 was an autonomous valet solution that makes it possible to automate such a service.

It has also been proposed to provide large capacity parking away from the airport, served by shuttles, sometimes automatic, which are, however, not well suited for passengers carrying several pieces of luggage, generating waiting times and resulting in disadvantages of using public transport.

Solutions of autonomous robots have also been proposed for picking up a passenger's vehicle as soon as it arrives in the parking facility. This robot will park the vehicle automatically and prepare it for returning. This solution also makes it possible to increase parking capacity by 50%.

Stuttgart's airport has been provided with an automated parking lot developed jointly with the operator APCOA, Bosch and Mercedes Benz to automate interactions between the vehicle, infrastructure technology and the parking operator. However, this solution is limited to cars pre-equipped for level-4 autonomous driving, which for the moment is still a very small part of the automobile fleet.

Patent application US2017167154 describes an automated vehicle parking system comprising at least one parking installation structure with a plurality of vehicle storage cells, a vehicle input/output arrangement, and a vehicle transport mechanism. The vehicle transport mechanism is arranged in the space adjacent to the vehicle storage cells in order to deliver and recover one or more vehicles relating to the vehicle storage cells.

Patent CN108331406 describes a frame-shaped self-driving vehicle transport device for moving vehicles.

Patent CN204457019 describes an intelligent three-dimensional stopping system based on a transfer robot and containing a vehicle.

The solutions of the prior art have several drawbacks.

Firstly, autonomous vehicle-moving robots are limited to movements over short distances and outside the public space. A movement on the public roadway would require either the presence on each robot of a human operator, or the installation of a level 4 or 5 autonomous driving solution, and a particularly demanding approval process. This is not compatible with the logic consisting of deploying a fleet of inexpensive robots operating in synergy.

Secondly, certain solutions of the prior art are limited to a category of pre-equipped motor cars.

BRIEF SUMMARY

In order to remedy these disadvantages, the present disclosure relates, in the broadest sense, to an automated parking system for motor cars including:

- at least one first infrastructure comprising a storage space for storing vehicles and having transfer stations between the public access road and the storage space;
- at least one autonomous robot of a first type having means for the lifting an autonomous car from the outside and moving it in the first storage space;
- as well as a supervisor for calculating the trajectories of the at least one autonomous robot, characterized in that it further comprises:

- at least one second infrastructure comprising a second storage space for storing vehicles; and
- at least one autonomous transporter of a second type comprising rolling means for driving on the public road and having a platform for receiving a motor vehicle.

In the case of an installation at an airport, it is, in particular, possible to provide a plurality of first infrastructures, each being situated in immediate proximity to the entrance of one of the terminals.

Advantageously, the autonomous transporters of a second type have a platform for receiving and holding a transporter, and means for temporarily locking the transporter onto the platform during the transit time. According to one variant, the autonomous transporters of a second type have a platform for receiving and holding a car deposited by a transporter, and means for temporarily locking the car onto the platform during the transit time.

BRIEF DESCRIPTION OF THE DRAWINGS

The present disclosure will be better understood on reading the following description, which relates to a non-limiting exemplary embodiment that is illustrated by the appended drawings, in which.

DETAILED DESCRIPTION

Figure 1:
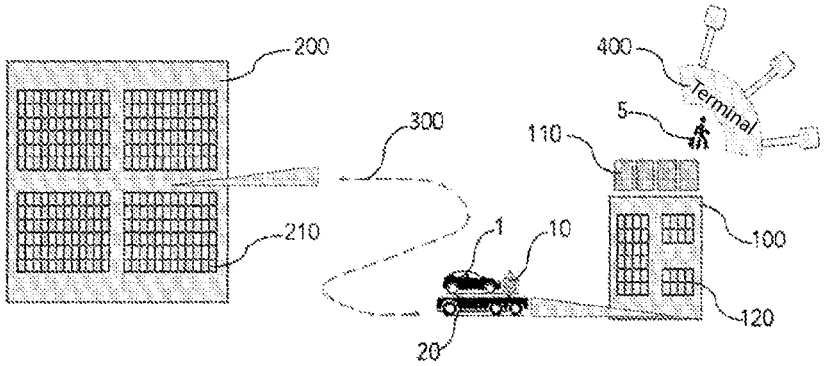
FIG. 1 shows a schematic view of an example of a parking system according to the present disclosure.
Figure 2:
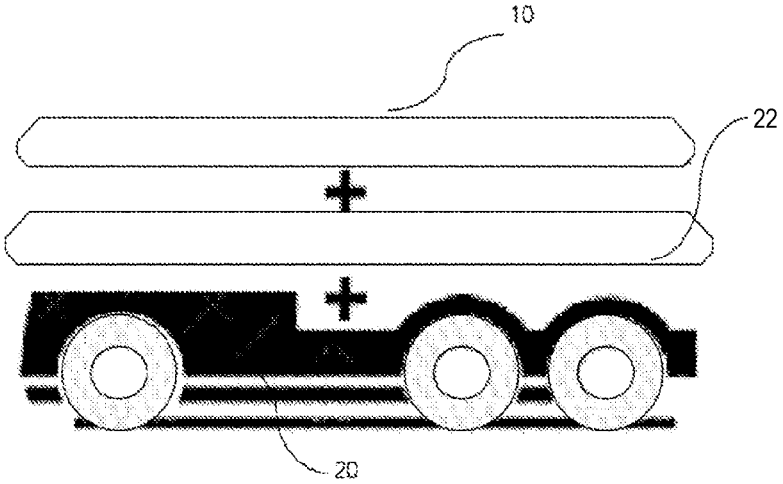
FIG. 2 shows a schematic view of transporters according to the present disclosure.
Figure 3:
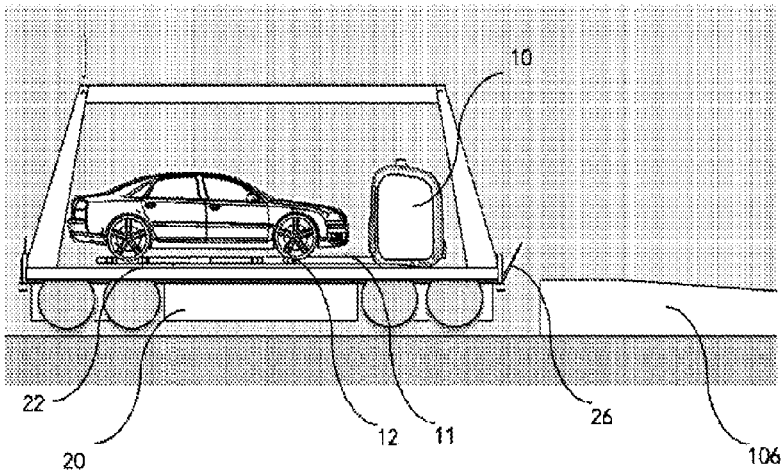
FIG. 3 shows a schematic view of an autonomous transporter according to the present disclosure.

The system according to the present disclosure is based on a combination of two types of fixed infrastructures and means for transporting motor cars of two different types, as well as two types of machines for moving motor cars, one for the movements on one of the parking areas only, the other for the movements between the parking areas of the two infrastructures.

The infrastructures comprise:

A first storage space (100) intended for receiving motor cars then returning them to the user, for temporary storage of reduced capacity and short duration, and handling it by an autonomous transfer vehicle between the two infrastructures;

A second storage space (200) of large capacity, greater than that of the first infrastructure, intended for the long-term storage of motor cars, and the pickup by an autonomous transfer vehicle between the two infrastructures; and A connecting road (300) between the two storage spaces (100, 200). This connecting road (300) can be an existing road, for example, a route intended for the circulation of vehicles, or reserved for the transit of autonomous transfer vehicles.

The first storage space (100) is located in the immediate proximity of the pedestrian access site to be served and can be connected to this site by mechanical means, for example, a moving walkway or an escalator. It has one or several neighboring parking areas, for the temporary storage of a limited number of vehicles.

The transporters (10, 20) are autonomous mobile equipment whose movement is coordinated by a supervisor. The transporters (10, 20) include:

A fleet of autonomous transporters (10) of a first type consisting of robotic transporters for moving motor vehicles, comprising a chassis provided with means for lifting the vehicle to be moved, for example, by arms coming into contact with the tire treads of the vehicle's wheels, and means of autonomous movement between a pickup location of a vehicle and a location for depositing the vehicle. It is, for example, a transporter described in patent application WO2020128380.

One or more of a second type of autonomous transporters (20) consisting of a vehicle, in particular, an autonomous vehicle, comprising means for running on the ground suitable for road traffic, and a platform for loading one or several motor cars. It is, for example, a transporter described in patent EP2173581. The second type of autonomous transporters (20) have a platform (22) for receiving and holding either a transporter (10) or a car (1) deposited by a transporter (10), and means for temporarily locking the car (1) or the transporter (10) onto the platform (22) during the transit time.

The system also comprises a supervisor ensuring the optimization of the movements of the various autonomous carriers on and between each of the infrastructures, according to arrangements that are described, for example, in patent application WO2021009453.

The first type of transporters (10) consist of flat chassis (11) low in height to allow engagement under an autonomous car (1), the chassis comprising means (12) making it possible to lift the autonomous car (1) under which the chassis is positioned, for example, articulated arms that are positioned on either side of the wheels of the car (1) to lift it sufficiently so that it no longer rests on the ground. The transporter (10) then moves autonomously via wheels or crawler tracks to carry the car (1) to its depositing point.

The pickup point is, during the arrival of a car, a pickup area (110) forming a transfer port between the public road and the storage space (100). This port allows the user (5) to park his car, retrieve, if necessary, the luggage from the trunk, close the car and go into the terminal (400). Only the pickup area (110) is accessible by users. This area can be formed by a closed building, with an access port opening on the public road and pedestrian accesses to allow users to circulate between the pickup area (110) and the public space.

The first storage space adjacent to the pickup area (110) is accessible by the transporters (10), which are configured to pick up a vehicle and move it automatically to a transitional parking location (120). These transitional parking locations (120) are intended for the temporary storage of cars that have just been picked up, the time of their transfer to the long-term storage space (200), as well as for cars coming from the long-term storage space (200) awaiting retrieval by a user.

Of course, when the flow of incoming or outgoing cars is low, the transporter (10) can provide the direct transfer between the second type of autonomous transporter (20) and the pickup area (110).

The second storage space (200) has one or more parking areas, with an overall capacity of at least ten times, and preferably at least thirty times greater than the capacity of the parking area(s) of the first storage space (100).

The transfer between the two storage spaces (100, 200) and the second type of autonomous transporter (20) is carried out by the transporters (10).

According to a first variant, the transporter (10) remains on the platform (22) of the second type of autonomous transporter (20) during the transfer between storage areas, and ensures the movement of the car, upon the arrival of the second type of autonomous transporter (20) on the storage space (200), to a storage location (210). The connection between the two transporters (10, 20) is then provided by an automatic mechanical clamping system ensuring the securing of the chassis (11) of the transporter (10) to the chassis of the transporter (20) for the transit time. This clamping system consists, for example, of electrical, hydraulic or pneumatic locking mechanical connectors.

According to a second variant, the transporter (10) deposits the car (1) onto the second type of autonomous transporter (20) and remains in the storage area to which it is assigned.

To facilitate loading onto the transporter (20), the storage spaces (100, 200) are optionally equipped with raised loading platforms (106) with a height corresponding substantially to the height of the chassis of the transporter (20). The transporter (20) has a ramp (26) allowing the rolling at constant level of the first type of transporter (10).

The solution according to the present disclosure makes it possible to solve a particularly complex equation in a dense environment;

maneuvering agility to operate in the constricted space of vehicle storage queues;

very diverse vehicle handling capability;

ability to operate on unpaved surfaces; and compliance with regulatory constraints relating to operation on public roads.

The invention claimed is:

1. An automated parking system for motor cars, comprising:

at least a first infrastructure comprising a storage space for storing vehicles and having transfer stations between a public access road and the storage space;

at least one autonomous robot of a first type having means for lifting an autonomous car from the outside and moving it in a first storage space;

a supervisor for calculating trajectories of the at least one autonomous robot;

at least one second infrastructure comprising a second storage space for storing vehicles;

a connecting road between the infrastructures;

at least one autonomous transporter of a second type comprising means for driving on the connecting road and having a platform for receiving a motor vehicle; and wherein the at least one autonomous transporter of a second type has a platform for receiving and holding the at least one autonomous robot, and means for temporarily locking the at least one autonomous robot onto the platform during transit.

2. The automated parking system for motor cars according to claim 1, wherein the platform of the at least one autonomous transporter of the second type is also for receiving and holding a car deposited by the at least one autonomous robot, and the at least one autonomous transporter of the second type includes means for temporarily locking the car onto the platform during transit.

3. An automated parking system for vehicles, comprising:

at least one first infrastructure comprising a storage space for storing vehicles and having transfer stations between a road and the storage space;

at least one autonomous robot having a mechanism configured to lift a vehicle from an exterior of the vehicle, the at least one autonomous robot being capable of moving a vehicle in a first storage space;

a supervisor for calculating trajectories of the at least one autonomous robot;

at least one second infrastructure comprising a second storage space for storing vehicles;

a connecting road extending between the at least one first infrastructure and the at least one second infrastructure;

at least one autonomous transporter configured to travel on the connecting road and having a platform configured to receive a vehicle thereon; and wherein the platform of the at least one autonomous transporter is further configured to receive and hold the at least one autonomous robot thereon, the at least one autonomous transporter having means for temporarily locking the at least one autonomous robot thereon.

4. The automated parking system for motor cars according to claim 3, wherein the platform of the at least one autonomous transporter has means for temporarily locking a vehicle thereon.

* * * * *